US005765402A

United States Patent [19]

Ikeda et al.

[11] Patent Number: 5,765,402

[45] Date of Patent: Jun. 16, 1998

[54] SPIN EXTRACTOR

[75] Inventors: Tomohiko Ikeda, Kusatsu; Yoshitaka Tsunomoto, Otsu; Masafumi Nishino, Kyoto; Kouichi Hatsuda, Otsu, all of Japan

[73] Assignee: Sanyo Electric Co., Ltd., Osaka, Japan

[21] Appl. No.: 800,807

[22] Filed: Feb. 18, 1997

[30] Foreign Application Priority Data

Feb. 27, 1996 [JP] Japan ..... 8-067364

[51] Int. Cl.[6] ..... D06F 33/02

[52] U.S. Cl. ..... 68/12.06

[58] Field of Search ..... 68/12.06; 34/58, 34/319; 210/144

[56] References Cited

U.S. PATENT DOCUMENTS

| | | | |
|---|---|---|---|
| 3,674,419 | 7/1972 | Tichy | 68/12.06 X |
| 5,165,260 | 11/1992 | Geiger | 68/12.06 X |
| 5,692,313 | 12/1997 | Ikeda et al. | 68/12.06 X |

FOREIGN PATENT DOCUMENTS

| | | |
|---|---|---|
| A-6-254294 | 9/1994 | Japan . |
| A-8-266788 | 10/1996 | Japan . |

*Primary Examiner*—Philip R. Coe
*Attorney, Agent, or Firm*—Oliff & Berridge, PLC

[57] ABSTRACT

In a spin extractor, an eccentric load judging unit judges the magnitude of the eccentric load based on the amplitude of fluctuations in the motor current while a drum is rotated at a speed at which the centrifugal force on fabric articles contained in the drum is a little larger than the gravity. If the magnitude of the eccentric load detected is larger than predetermined, a balance correcting operation is conducted by a speed control unit. That is, a speed reducing position designating unit sends a pulse signal to the speed control unit at the moment when the eccentric load of the drum comes just before the highest position, in response to which the speed of the drum is reduced momentarily. When the speed is reduced, the centrifugal force is smaller than the gravity, so that the fabric articles crammed and piled fall off the inner peripheral wall of the drum. Thus the fabric articles can be scattered almost evenly.

9 Claims, 8 Drawing Sheets

BEFORE EXTRACTING OPERATION

IN DETECTING ECCENTRIC LOAD

IN BALANCE CORRECTING OPERATION

IN DETECTING ECCENTRIC LOAD AGAIN

WHEN NO WATER IS LEFT

IN DETECTING ECCENTRIC LOAD

IN BALANCE CORRECTING OPERATION

IN DETECTING ECCENTRIC LOAD AGAIN

AFTER DRAINING WATER

IN PRELIMINARY EXTRACTING OPERATION

SPIN EXTRACTOR

The present invention relates to a spin extractor for extracting liquid such as water or dry cleaning solvent from wet fabric articles by rotating a drum with the fabric articles contained therein at high speed about a horizontal axis.

BACKGROUND OF THE INVENTION

In a drum type (or a front loading type) spin extractor, wet fabric articles are contained in a basket drum after washed and rinsed, and the drum is rotated at high speed about the horizontal axis. The spin extractor of this type is accompanied by some serious problems, one of which is the abnormal vibration and noise that occur due to the unbalanced load around the axis when the drum is rotated at high speed with fabric articles unevenly distributed on the inner peripheral wall thereof.

Some spin extractors have been proposed for solving the above problem. In the spin extractor disclosed in the Japanese Published Unexamined Patent Application No. H6-254294, for example, the drum is initially rotated at a low speed to distribute fabric articles evenly in the drum, whereafter the extracting operation is carried out at high speed. In concrete, the spin extractor is designed so that the fabric articles are distributed evenly by a rotation control process including two steps: first, the drum is rotated at a low speed for a short time (e.g. at a speed such that the centrifugal acceleration generated at the circumference of the drum is about 1.2–1.5 G, where G is the gravitational constant, and the duration is about 5 seconds); second, the drum is rotated at another low speed (e.g. at 2.3–2.6 G for about 20 seconds) which is a little higher than said low speed but is much lower than a full speed for carrying out the proper extracting operation.

In addition, the above spin extractor is equipped with a vibration sensor at the pedestal for detecting an eccentric load due to an uneven distribution of fabric articles in the drum. When an abnormal vibration is detected by the vibration sensor in raising the speed of the drum to the proper extracting speed, the drum speed is reduced.

Since it is not assured that the fabric articles are redistributed evenly in the drum by just one attempt of rotating the drum at the lower speeds, it is usually necessary to repeat the balance correcting operation and the eccentric load detecting operation several times. In the above conventional spin extractor, however, there is a large difference between the speed for correcting the balance and the speed for detecting the eccentric load, so that the extracting operation resultantly takes a long time if the operations are repeated several times.

Further, in the above spin extractor, when the eccentric load detecting operation is carried out, the speed of the drum is raised nearly to the high speed for carrying out the proper extracting operation. Thus, if the eccentric load in the drum is excessive, the drum rotating motor is over-loaded and may be damaged in the eccentric load detecting operation.

SUMMARY OF THE INVENTION

In view of the above problems, the applicant of the present invention has proposed a spin extractor disclosed in the Japanese Published Unexamined Patent Application No. H8-266788. In the spin extractor, the state of uneven distribution of fabric articles in the drum is judged based on the fluctuations in the electric current to the drum motor. In case that the eccentric load detected is judged to be too large, a balance correcting operation is carried out, whereas, in case that the eccentric load is judged to be small enough, a proper extracting operation is carried out at a high speed.

The present invention provides an improvement to the spin extractor cited above, and an object is to provide a spin extractor in which fabric articles in the drum are scattered and redistributed almost evenly in a shorter time, thus preventing an abnormal vibration or noise during the extracting operation and enhancing the extracting efficiency.

In a spin extractor for extracting liquid from fabric articles contained in a drum by rotating the drum about a horizontal axis, the first spin extractor according to the present invention includes:

a) a motor for rotating the drum;

b) an eccentricity detector for detecting the magnitude of an eccentric load due to an uneven distribution of the fabric articles while the fabric articles are rotated and pressed on the inner peripheral wall of the drum by the centrifugal force;

c) a judging unit for judging whether the magnitude of the eccentric load detected by the eccentricity detector is smaller than a predetermined value;

d) a position detector for detecting that the eccentric load comes to a proximity to a predetermined angular position while the drum is rotated; and e) an operation controller for controlling the motor by a process including:

a first step wherein the motor is controlled to rotate the drum at a first speed at which the centrifugal force acting on the fabric articles is larger than the gravity, and the judging unit judges the eccentric load;

a second step wherein, when the magnitude of the eccentric load is judged to be larger than the predetermined value in the first step, the speed of the drum is reduced for a short time or momentarily to a second speed where the centrifugal force on the fabric articles is smaller than the gravity according to a timing signal generated by the position detector; and a third step wherein, when the magnitude of the eccentric load is judged to be smaller than the predetermined value in the first step, the speed of the drum is raised to a high speed for the proper extracting operation.

The second spin extractor according to the present invention, which is a modification to the first spin extractor, is characterized in that the speed of the drum is reduced momentarily when the part of drum where the eccentric load exists is in the upper half of the rotation, i.e. in the range after the eccentric load passes the level of the drum axis upwards and before it passes the level of the drum axis downwards.

The third spin extractor according to the present invention, which is a modification to the second spin extractor, is characterized in that the operation controller controls the motor to reduce the drum speed momentarily to the second speed once every time the drum is rotated a plurality of times at a speed at which the centrifugal force on the fabric articles is larger than the gravity.

The fourth spin extractor according to the present invention, which is a modification to one of the foregoing three spin extractors, is characterized in that the judgement on the eccentric load in the first step and the momentary reduction in the drum speed to the second speed in the second step are carried out under the condition that a quantity of liquid is retained in the lower part of the drum so that the fabric articles come in contact with the liquid and the drum is rotated at the first speed where the centrifugal force acting on the fabric articles permeated by the liquid is larger than the gravity acting thereon.

The fifth spin extractor according to the present invention is a modification to the fourth spin extractor and is applicable to such a spin extractor that the extracting operation is carried out subsequent to a washing or rinsing operation. The fifth spin extractor is characterized in that the judging unit judges the eccentric load in the state where a predetermined quantity of the liquid is left in the drum so that the fabric articles come in contact with the liquid after a part of the liquid used in the washing or rinsing operation is drained.

The sixth spin extractor according to the present invention, which is a modification to the fifth spin extractor, is characterized as follows. When the magnitude of the eccentric load is judged to be smaller than a predetermined value by the judging unit, a preliminary extracting operation is carried out at a predetermined extracting speed of the drum which is somewhat lower than the high speed for the proper extracting operation. Then the drum speed is reduced to the first speed to judge the eccentric load again. If the magnitude of the eccentric load detected after the preliminary extracting operation is judged to be still larger than the predetermined value, the operation controller reduces the drum speed momentarily to the second speed to redistribute the fabric articles in the drum. If the magnitude of the eccentric load detected after the preliminary extracting operation is judged to be smaller than the predetermined value, the operation controller controls to rotate the drum at the high speed for the proper extracting operation.

In any one of the first through sixth spin extractors, the eccentricity detector may be composed of a motor current detector for detecting a motor current supplied to the motor and a calculating unit for calculating an amplitude of fluctuations in the motor current, and the judging unit may make the judgement by comparing an output from the calculating unit to a predetermined value.

In the above constitution, the position detector may be constituted to generate a position detecting signal based on a peak position in the fluctuations in the motor current detected by the motor current detector.

Further, it is preferable that, while the eccentric load is being detected, the operation controller controls the motor so that the drum is rotated at a speed in proximity to a speed where the centrifugal force acting on the fabric articles is almost equal to the gravity acting thereon.

In the first spin extractor according to the present invention, the operation controller controls the motor as follows: first, the drum is rotated at a first speed where the fabric articles are rotated and pressed on the inner peripheral wall of the drum, that is, where the centrifugal force acting on the fabric articles is larger than the gravity acting thereon. The eccentricity detector detects the magnitude of the eccentric load due to an uneven distribution of the fabric articles and the judging unit judges whether the eccentric load detected is smaller than a reference value while the drum is thus rotated. The reference value used here is predetermined so that, in case that the magnitude of the eccentric load detected is smaller than the predetermined value, no abnormal vibration occurs even if the proper extracting operation is started without correcting the loading state. When the magnitude of the eccentric load detected is smaller than the predetermined value, the operation controller controls the motor so that the speed of the drum is raised to the high speed for the proper extracting operation.

When, on the other hand, the magnitude of the eccentric load is judged to be larger than the predetermined value, a balance correcting operation is necessary to correct the distribution of the fabric articles. In this case, when the position detector detects that the eccentric load (i.e., the part of the drum where the heaviest bunch of the fabric articles is lying) comes in the upper part of the drum, the operation controller controls the motor to reduce the drum speed to the second speed for a short time, or momentarily.

The second speed and the duration of said "for a short time" or "momentarily" are determined so that the centrifugal force is decreased and the bunch of fabric articles causing the eccentric load in the drum fall off from the inner wall due to the gravity. Preferably the speed and the duration are determined so that only some in the bunch of the fabric articles that lie closer to the drum axis fall off. Thus the distribution of the fabric articles in the drum is corrected.

After that, the operation controller immediately controls the motor so that the speed of the drum is restored to the first speed, and the new eccentric load resulting from the change in the distribution of the fabric articles is detected by the eccentricity detector. Here, if the magnitude of the eccentric load is smaller than the predetermined value, the speed of the drum is raised to the high speed to carry out the proper extracting operation. If, on the other hand, the magnitude of the eccentric load is still larger than the predetermined value, the balance correcting operation is carried out again. Thus, since the operation controller controls the rotation of the drum so that the fabric articles crammed and piled are scattered to the other part on the inner peripheral wall of the drum, it results finally that the fabric articles are scattered almost evenly on the inner peripheral wall of the drum.

In the second spin extractor, the operation controller controls the motor so that the speed of the drum is reduced momentarily to the second speed when the part of drum where the eccentric load exists is in the upper half of the rotation, i.e. within the range after the eccentric load passes the level of the drum axis upwards and before it passes the level of the drum axis downwards. In this case, the duration of the speed reduction is controlled to be less than a half of the rotation of the drum. After the momentary speed reduction, the drum speed is restored to the first speed.

For scattering the fabric articles more effectively, it is preferable to start reducing the drum speed at the moment when the eccentric load arrives at a proper angular position. Because of inertia, it is difficult to make the fabric articles fall off by reducing the speed after the eccentric load has passed the highest position of the drum. Taking account of this, it is preferable to reduce the speed of the drum when the eccentric load comes in an angular range of about 90° before the highest position of the drum. By this method, the fabric articles can fall off from the inner peripheral wall of the drum easily and be scattered thereon adequately.

The distribution of the fabric articles can be changed greatly by reducing the speed of the drum just once in the above described way. Hence, it is preferable to repeat the eccentric load detecting operation and the speed reducing operation alternately and to quit the alternating process if the magnitude of the eccentric load is settled to be smaller than the predetermined value. Once the speed of the drum is reduced, it is difficult to restore the speed and stabilize it at the original speed promptly. Further, in order to detect the magnitude and position of the eccentric load, it is necessary to maintain the drum speed at the speed for detecting the eccentric load for more than a rotation. Hence, in the third spin extractor, first the drum is rotated a plurality of times at the detecting speed, and if the magnitude of the eccentric load is judged to be larger than the predetermined value, the speed of the drum is reduced just once momentarily and is promptly restored to the original detecting speed again. The above process may be repeated until the magnitude of the eccentric load detected is settled to be smaller than the predetermined value.

In order to scatter the fabric articles by the balance correcting operation as described above, it is necessary that the fabric articles can move freely in the drum to some extent. Here, however, when a fabric article having a large volume, such as a blanket or Japanese futon (bedding), is contained in the drum, the fabric article may occupy an extremely large space, which prevents the other fabric articles from moving and scattering themselves. Hence, in the fourth spin extractor, the eccentric load detecting operation and the balance correcting operation are carried out under the condition that a quantity of liquid, such as water or solvent, is retained in the lower part of the drum. In this case, the fabric articles pressed on the inner peripheral wall of the drum come in contact with the liquid and absorb it when they pass the lower part of the drum while the drum is rotated. As a result, the fabric articles are constantly maintained to be wet adequately. When a fabric article is wet adequately, the volume thereof is smaller than usual. Therefore, by the fourth spin extractor, even when a fabric article with a large volume such as a futon is put in the drum, a sufficient space is left unoccupied around the drum axis, so that the fabric articles can be scattered easily by the balance correcting operation.

In the spin extractor used in a washing machine constituted so that the extracting operation is carried out subsequent to a washing or rinsing operation, the liquid used for the washing or rinsing is still retained in the drum when the washing or rinsing operation is about to be completed. Hence, in the fifth spin extractor, the liquid is utilized for the eccentric load detecting operation and the balance correcting operation carried out by the above fourth spin extractor. That is, in draining the liquid used in the washing or rinsing operation, an adequate quantity of the liquid is left in the drum without being drained. Then the drum is rotated for detecting the eccentric load with the liquid retained therein. By this method, the time for supplying a new liquid can be saved and the waste of water or solvent can be avoided.

There is a case that some fabric articles having a certain characteristics may not be scattered adequately by the balance correcting operation when the fabric articles hold a considerable quantity of liquid. Provided, for example, that fabric articles in the drum have diverse liquid-absorbing ratios and the drum is balanced by the balance correcting operation while the fabric articles have a considerable quantity of liquid. Then, as the proper extracting operation is carried out at the high speed and as the liquid is extracted, the balance may be lost because each fabric article has different liquid-absorbing ratio. Thus an abnormal vibration occurs.

In the sixth spin extractor, first the balance correcting operation is carried out with the fabric articles holding a considerable quantity of liquid. Then the liquid retained in the lower part of the drum is drained from the drum and a preliminary extracting operation is carried out at a preliminary extracting speed predetermined somewhat lower than the high speed for the proper extracting operation. Here, the preliminary speed is set at such a speed that is low enough to prevent the abnormal vibration even when the eccentric load changes as the liquid is extracted. After the preliminary extracting operation, the speed is reduced again to carry out the eccentric load detecting operation, where, if the magnitude of the eccentric load is larger than a predetermined value, the balance correcting operation is carried out.

In the above first through sixth spin extractors, the electric current supplied to the drum motor can be used for detecting the magnitude and angular position of the eccentric load. The state of the eccentric load is reflected in the fluctuations in the motor current detected by the motor current detector. Hence the magnitude of the eccentric load can be detected by detecting the amplitude of the fluctuations by the calculating unit in every rotation of the drum and comparing the amplitude to a predetermined value by the judging unit.

In this case, the peak of the fluctuations in the motor current is detected at the moment when the fabric articles causing the eccentric load arrive at an angular position in the upper part of the drum. Therefore, the timing at which the eccentric load comes in the upper part of the drum can be detected based on the position of the peak, i.e., on the timing at which the peak is detected in every rotation.

The fluctuations in the motor current appear more distinctly as the speed of the motor is lower. It is therefore preferable that the operation controller controls the motor to rotate the drum at a speed which is a little higher than the speed at which the centrifugal force on the fabric articles is almost equal to the gravity, whereby the eccentric load can be detected more accurately.

As described above, by the spin extractor according to the present invention, abnormal vibration or noise can be prevented perfectly since the eccentric load can be detected and judged assuredly without rotating the drum at high speed.

It takes a long time for the conventional spin extractors to correct the balance because the drum is rotated for a relatively long time at a low speed to detect the eccentric load. Further, in the conventional spin extractor, the rotation of the drum is controlled by a simple trial-and-error process without taking account of the position of the eccentric load at all. By the present invention, on the other hand, the eccentric load can be corrected more assuredly and in a shorter time since the drum is rotated within one rotation at the low speed and, further, the scattering operation is aimed at a part of the drum where the heaviest bunch of the fabric articles is lying. Even when the eccentric load cannot be corrected by one trial of the balance correcting operation, another trial can be carried out promptly as soon as a result of the detection is obtained since the difference between the eccentric load detecting speed and the balance correcting speed is small. Therefore, the fabric articles can be scattered adequately in a short time and the proper extracting operation can be carried out efficiently.

BRIEF DESCRIPTION OF THE DRAWINGS

Preferred embodiments of the spin extractor according to the present invention will be described below referring to the attached drawings wherein.

DETAILED DESCRIPTION OF PREFERRED EMBODIMENTS

The first embodiment of the spin extractor according to the present invention is described as follows referring to FIGS. 1A, 1B and 2.

Figure 1A:
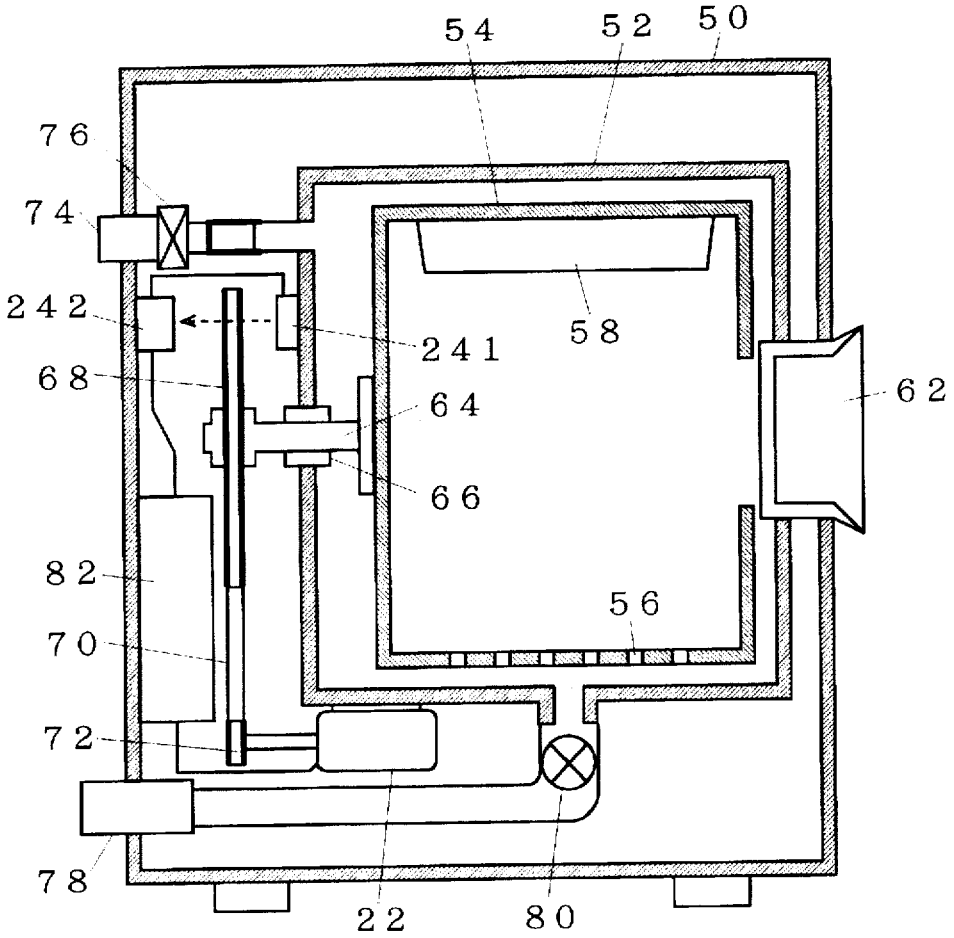
FIG. 1A is a vertical sectional view of a drum type washing machine in which a spin extractor of the first embodiment of the present invention is installed.
Figure 1B:
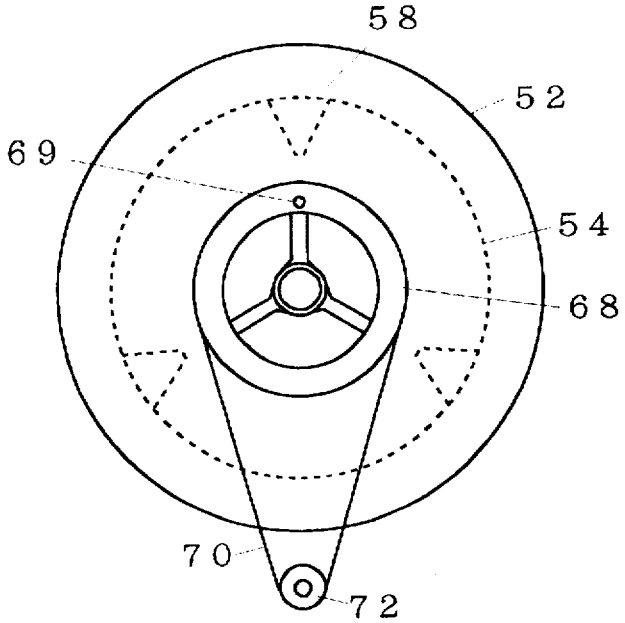
FIG. 1B is a rear view of the drum and its driving mechanism.

First, the whole structure of a drum type washing machine, in which a spin extractor of the first embodiment is installed, is described referring to FIGS. 1A and 1B. A tub 52 is disposed in an outer case 50. A drum 54 for containing fabric articles is sustained by a main shaft 64 and provided inside the tub 52. Perforations 56 are formed in the peripheral wall of the drum 54 so that water supplied in the tub 52 comes into the drum 54 and water extracted from fabric articles goes out of the drum 54. Three baffles 58 for lifting the fabric articles with the rotation of the drum 54 are provided on the inner peripheral wall of the drum 54 at angular intervals of 120°. An opening 62 is provided for throwing the fabric articles in the drum 54.

The main shaft 64 is supported by a bearing 66 fixed in the tub 52, and a main pulley 68 is fixed to the end of the main shaft 64. A motor 22 for rotating the drum 54 is placed beneath the tub 52, and a motor pulley 72 is provided on the shaft of the motor 22. The motor pulley 72 and the main pulley 68 are drivingly connected by a V belt 70. The water for washing or rinsing is supplied from outside through a water inlet 74 to the tub 52, and the flow rate of the water is regulated by a water-supply valve 76. The water in the tub 52 used in washing or rinsing, or the water extracted from the fabric articles, is drained through a drain outlet 78 which is opened and closed by a drain valve 80. A circuit unit 82 is provided for applying a driving voltage to the motor 22. The circuit unit 82 includes a controller 10, an inverter control circuit 20 and other related circuits, which will be detailed later.

A photo-emitter 241 and a photo-receiver 242 are set on the outer wall of the tub 52 and on the inner wall of the outer case 50, respectively. The photo-emitter 241 and the photo-receiver 242 face each other across the main pulley 68, thus constituting a rotation sensor. An opening 69 (FIG. 1B) is formed in the annular rim of the main pulley 68 between the photo-emitter 241 and the photo-receiver 242. A light from the photo-emitter 241 passes the opening 69 and reaches the photo-receiver 242 once in every rotation of the drum 54. Thus the photo-receiver 242 of the rotation sensor generates a detection signal (which is also referred to as a rotation marker) synchronized with the rotation of the drum 54.

Figure 2:
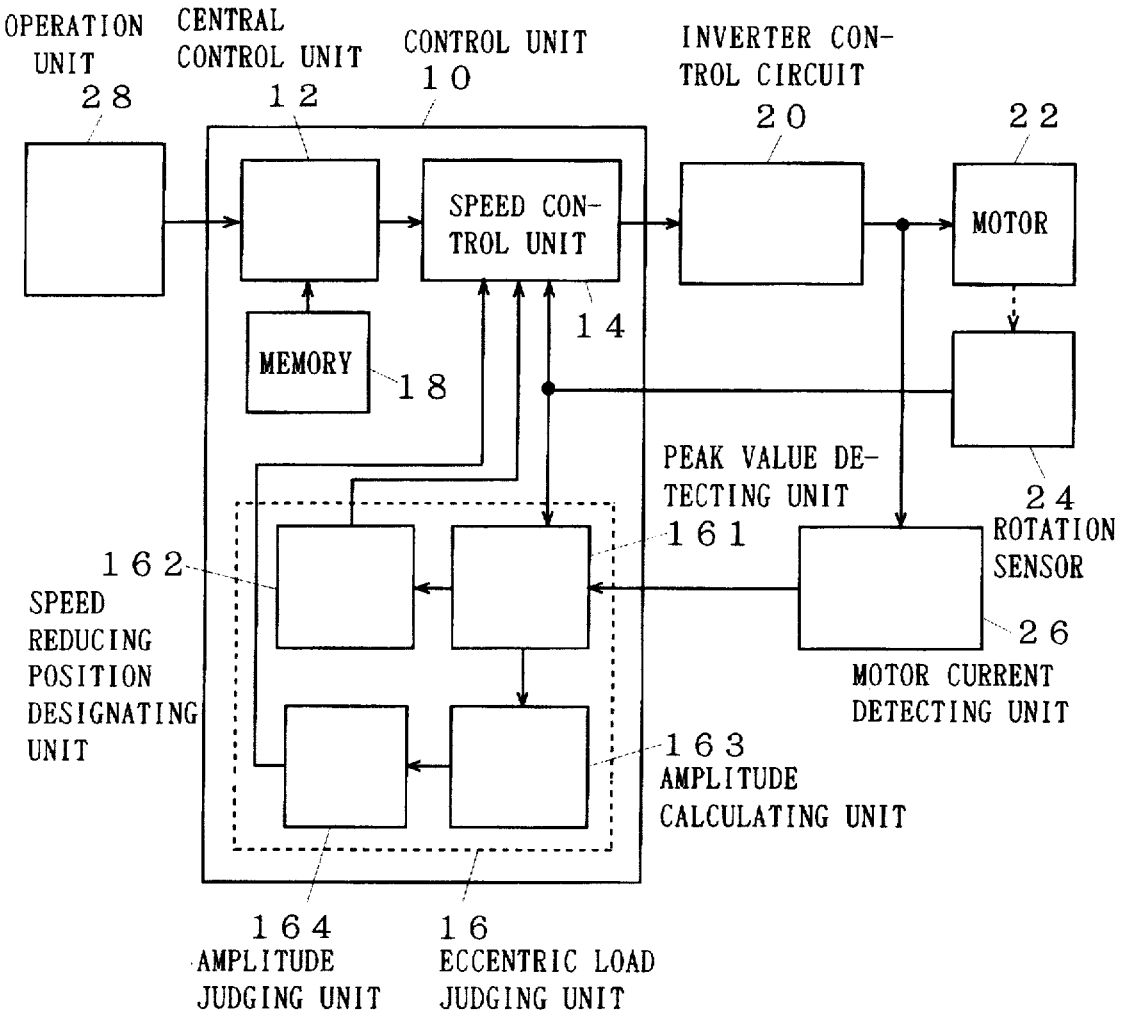
FIG. 2 is a schematic block diagram of an electric system of the spin extractor of the first embodiment.

Next, the constitution and operation of the electric system is described referring to FIG. 2, whose main portion is included in the circuit unit 82. The control unit 10 including several microcomputers is composed of a central control unit 12, a speed control unit 14, an eccentric load judging unit 16, a memory 18, etc. The eccentric load judging unit 16 is composed of a peak value detecting unit 161, a speed reducing position designating unit 162, an amplitude calculating unit 163, an amplitude judging unit 164, etc. Operating programs for conducting a laundry job including a washing process, a rinsing process and an extracting process are stored in the memory 18. When a user operates a key or keys on a operation unit 28 to select one of several extracting modes according to, for example, the type of the fabric to be washed, and further operates a key to start an extracting process, the central control unit 12 reads out a program corresponding to the selected mode from the memory 18 and executes the program to perform the extracting process.

The speed control unit 14 sends a speed designating signal to the inverter control circuit 20, wherein the speed designating signal designates not only the speed but also the direction of rotation of the drum 54. The inverter control circuit 20 converts the speed designating signal into a pulse width modulated (PWM) signal and applies a driving voltage corresponding to the PWM signal to the motor 22. The current to the motor 22 is detected by a motor current detecting unit 26, and a detection signal from the motor current detecting unit 26 is sent to the eccentric load judging unit 16.

Figure 3:
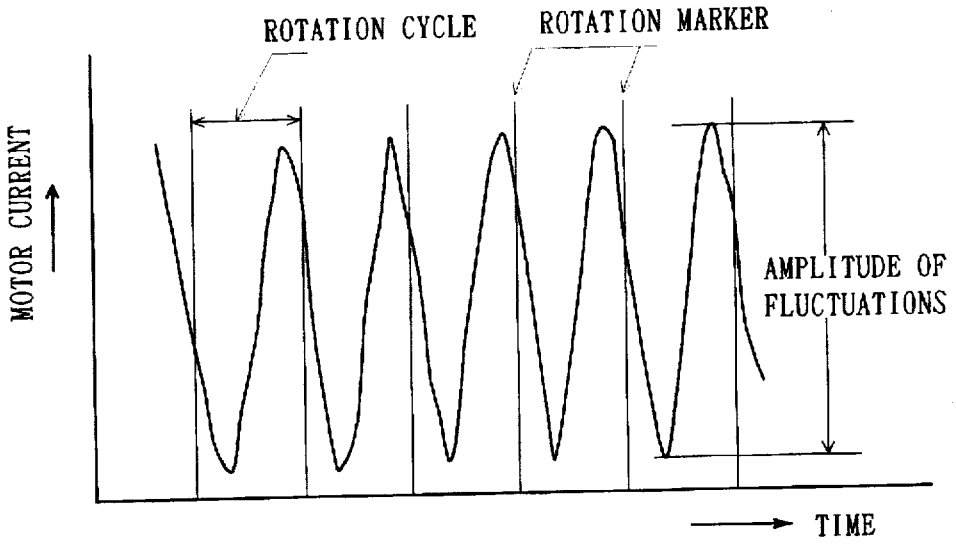
FIG. 3 is an example of a graph showing fluctuations in the motor current.

If the fabric articles are unevenly distributed in the drum 54, fluctuations corresponding to an eccentric load due to the uneven distribution are detected in the motor current. FIG. 3 shows an example of a waveform representing the effective value of the motor current when an eccentric load exists. In this graph, the rotation marker, generated by the rotation sensor 24 as described above, is a signal indicating each rotation cycle of the drum 54. The fluctuations in the motor current correspond to the fluctuations in the torque loaded on the motor 22, where a positive peak in the motor current appears at a timing when the torque is the largest in each rotation cycle of the drum 54. The torque is maximized when the fabric articles causing the eccentric load are about to be lifted to the upper part of the drum 54 against the gravity. Therefore, the positive peak in the motor current is usually detected when the eccentric load comes to a position within an angular range of about 90° before the highest position of the drum 54.

Figure 4:
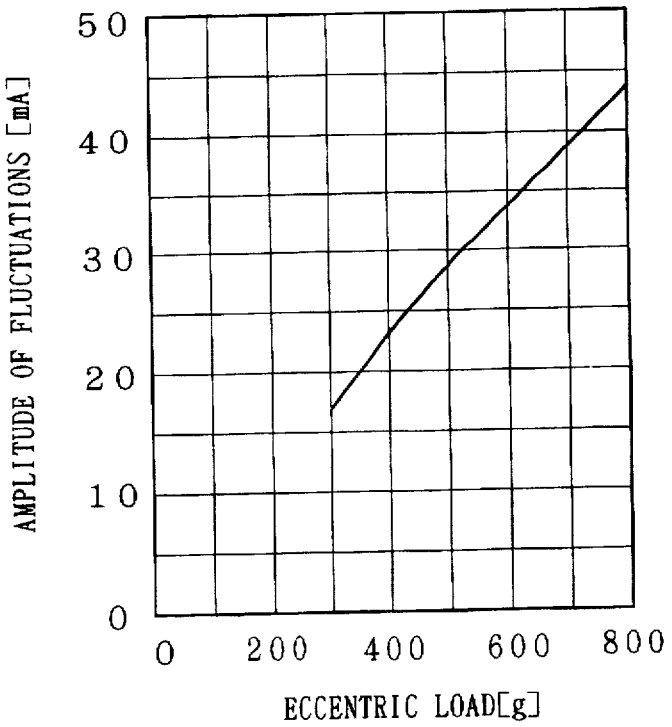
FIG. 4 is an example of a graph showing the relation between the magnitude of the eccentric load and the amplitude of fluctuations in the motor current.

The amplitude of the fluctuations in the motor current reflects the magnitude of the eccentric load. FIG. 4 is an example of the graph showing the relation between values of preset known magnitude of the eccentric load and values of amplitude of fluctuations in the motor current. Using such a graph, the magnitude of the eccentric load can be inferred from the amplitude of fluctuations in the motor current. Since there are various factors that cause fluctuations in the motor current other than the eccentric load, it is preferable to filter out a component having a frequency close to that corresponding to the speed of the drum 54 from the fluctuations in the motor current, whereby the amplitude of the fluctuations due only to the eccentric load can be measured more precisely.

Based on the detection signal from the motor current detecting unit 26, the eccentric load judging unit 16 detects and judges the eccentric load as follows. The peak value detecting unit 161 detects both a positive peak and a negative peak in the fluctuations in the motor current in each interval of the rotation markers generated by the rotation sensor 24 (i.e. in each rotation cycle of the drum 54). The data of the position of the positive peak detected is sent to the speed reducing position designating unit 162 and the data of the peak value is sent to the amplitude calculating unit 163. When the positive peak is generated, as described above, the eccentric load is at an almost regular angular position (which is usually a position within the angular range of about 90° before the highest position of the drum 54). Therefore, the speed reducing position designating unit 162 generates a pulse signal at the moment when the positive peak is detected, or a little earlier or later by a predetermined time interval than the detection of the positive peak. The pulse signal is sent to the speed control unit 14.

The amplitude calculating unit 163 calculates the amplitude of the fluctuations in the motor current in each rotation cycle of the drum 54 based on the positive and negative peak values. As described above, the amplitude corresponds to the magnitude of the eccentric load. The amplitude judging unit 164 judges whether the amplitude is smaller than a predetermined reference value, and generates a high level signal if the amplitude is smaller than a predetermined value. The above reference value for the judgement is predetermined taking account of the maximum magnitude of the eccentric load allowable for carrying out the proper extracting operation at high speed.

While controlling the motor 22 to rotate the drum 54 at a predetermined speed, the speed control unit 14 receives a signal representing the result of the judgement on the eccentric load from the amplitude judging unit 164 and a pulse signal designating the position to reduce the speed from the speed reducing position designating unit 162, and generates a new speed designating signal according to the signals received.

Figure 5:
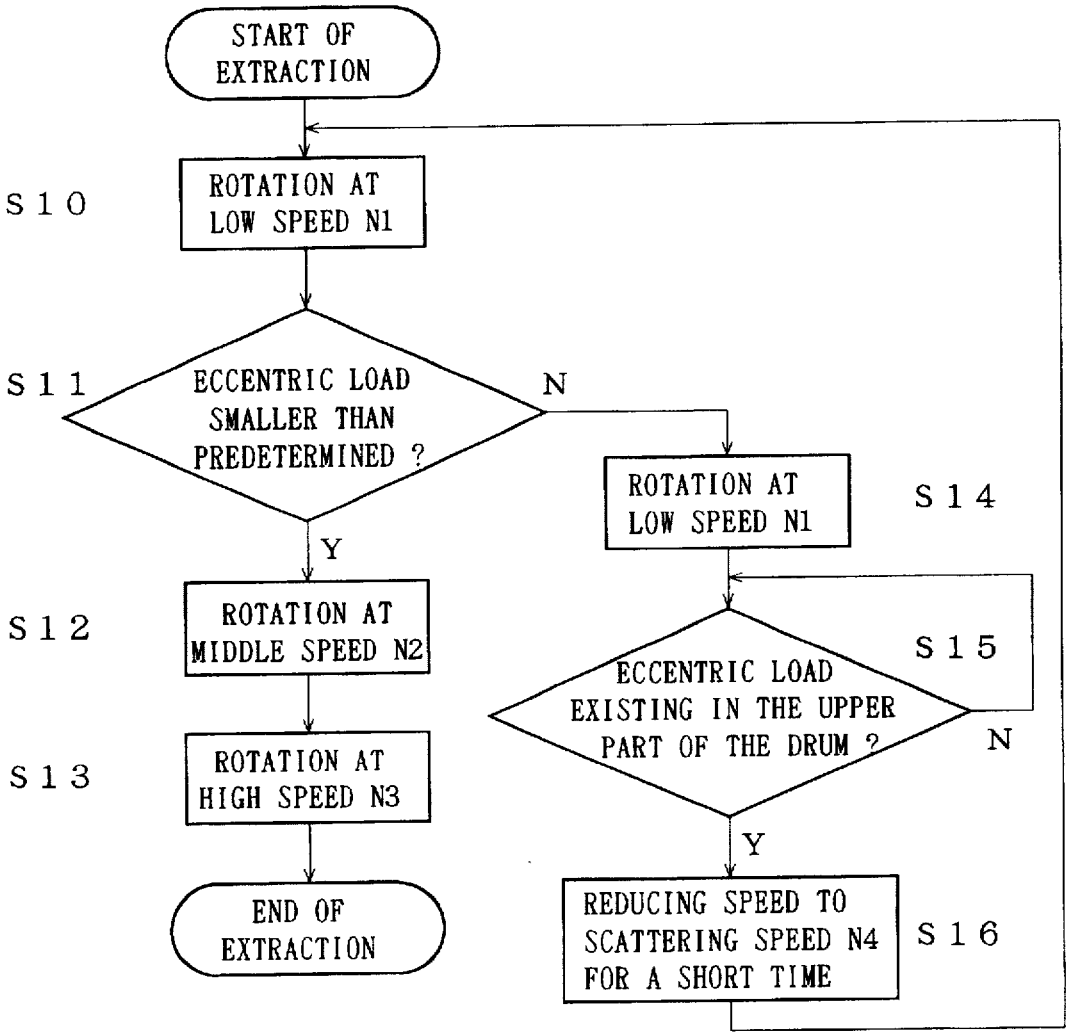
FIG. 5 is a flow chart of an extracting process by the spin extractor of the first embodiment.

Next, the water extracting process by the washing machine having the above constitution is described referring to the flow chart of FIG. 5 and the illustrations of FIGS. 6A–6D.

Figure 6A:
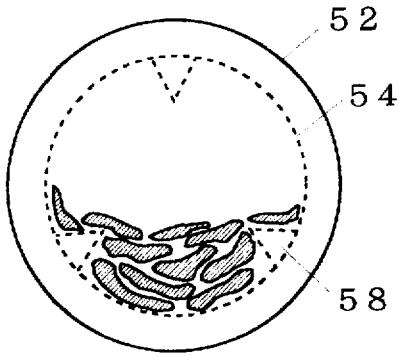
FIGS. 6A, 6B, 6C and 6D illustrate a movement of the fabric articles in the drum of the spin extractor of the first embodiment.

Before the extracting process is started, the fabric articles are crammed and piled in the lower part of the drum 54 as shown in FIG. 6A. When a user operates a key or keys of the operation unit 28 to start the extracting process, the speed control unit 14 starts the motor 22 and generates such a speed designating signal that the drum 54 is rotated at a low speed N1 where the centrifugal force acting on the fabric articles is a little larger than the gravity acting thereon, and the inverter control circuit 20 applies a voltage to the motor 22 according to the speed designating signal (step S10). It is preferable to determine the low speed N1 according to the diameter of the drum. For example, in case the diameter of the drum is 700 [mm], a preferable low speed is about 50–60 [rpm], and in case the diameter is 910 [mm], a preferable low speed is about 80–90 [rpm].

Figure 6B:
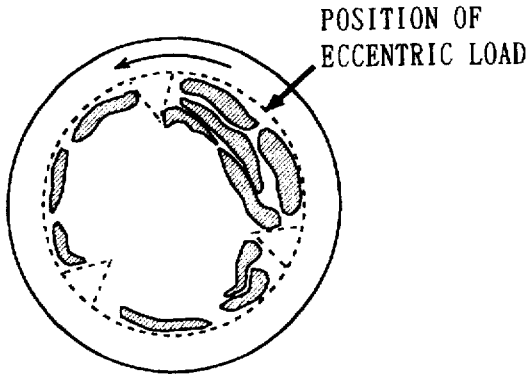

While the drum 54 is rotated at the low speed N1, all the fabric articles are pressed on the inner peripheral wall of the drum 54 due to the centrifugal force (FIG. 6B). During the rotation, the motor current detecting unit 26 detects the electric current to the motor, and the eccentric load judging unit 16 detects the magnitude of the eccentric load based on the fluctuations in the motor current detected and judges whether the eccentric load is smaller than predetermined. Provided, for example, that the maximum allowable eccentric load is predetermined at 500 [g], the eccentric load judging unit 16 judges whether the amplitude of the fluctuations in the motor current is equal to or smaller than a known amplitude corresponding to the 500 [g] of the eccentric load (step S11).

If the amplitude of the fluctuations in the motor current is judged to be smaller than the predetermined value, the operation proceeds to step S12, where a middle speed extracting operation is carried out. That is, on receiving a high level signal from the amplitude judging unit 164, the speed control unit 14 generates such a speed designating signal that the drum 54 is rotated at a middle speed N2, and the inverter control circuit 20 applies a voltage to the motor 22 according to the speed designating signal. For example, the middle speed N2 may be about 500 [rpm]. By continuing the middle speed extracting operation for a predetermined time, water can be extracted from the fabric articles roughly.

After the middle speed extracting operation is finished, the operation proceeds to step S13, where a high speed extracting operation is carried out. That is, the speed control unit 14 generates such a speed designating signal that the drum 54 is rotated at a high speed N3, and the inverter control circuit 20 applies a voltage to the motor 22 according to the speed designating signal. It is preferable to determine the high speed N3 corresponding to the extracting mode selected by the user or corresponding to the weight of the fabric articles detected automatically beforehand by the washing machine. It is further preferable to determine the high speed N3 taking account of the type of the fabric to be washed in order to minimize the damage to the fabric. A standard value of the high speed is about 700 [rpm]. The high speed extracting operation is continued for a time period predetermined so that the water can be adequately extracted from the fabric articles. After the predetermined time elapses, the drum 54 is stopped. Thus the extracting process is completed.

When the eccentric load is judged to be larger than the predetermined value in step S11, the operation proceeds to steps S14–S16, where the balance correcting operation is carried out to scatter the fabric articles evenly on the inner peripheral wall of the drum 54. In the balance correcting operation, the rotation of the drum 54 is controlled as follows.

First, the speed control unit 14 controls the motor 22 so that the speed of the drum 54 is maintained at the low speed N1 cited above (step S14). At the moment the eccentric load due to the uneven distribution of the fabric articles arrives at a proximity to the highest position of the drum 54 or at a predetermined position before the highest position, the speed reducing position designating unit 162 sends a pulse signal to the speed control unit 14 (step S15). On receiving the pulse signal, the speed control unit 14 generates a speed designating signal for a predetermined short time t ("speed reducing time") so that the speed of the drum 54 is reduced momentarily to a scattering speed N4, which is lower than the speed N1 (step S16).

Figure 6C:
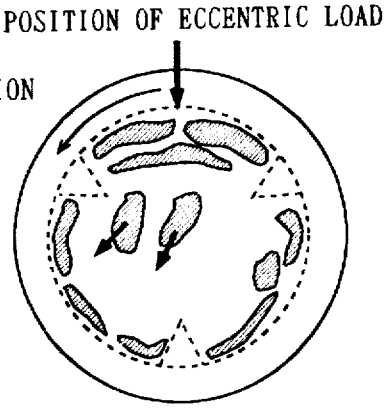
Figure 6D:
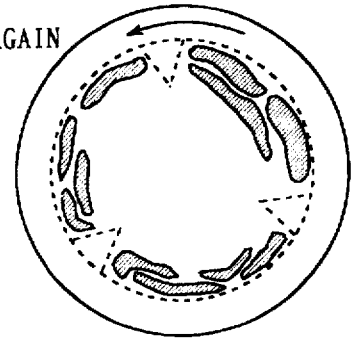

The pulse signal is sent to the speed control unit 14 at the moment when the bunch of fabric articles which are crammed and piled in the drum 54 and are causing the eccentric load comes in the upper part of the drum 54. The momentary speed reduction effected responsive to the pulse signal generates a state where the centrifugal force acting on the fabric articles pressed on the inner peripheral wall of the drum 54 becomes smaller than the gravity. Hence, the fabric articles causing the eccentric load fall off due to the gravity, whereby are scattered (FIG. 6C).

By setting the scattering speed N4 and the speed reducing time t properly, it is possible to make only some of the fabric articles that lie closer to the drum axis fall off. That is, the centrifugal force acting on each fabric article in the drum 54 is proportional to the distance from the drum axis. Accordingly, the closer the fabric article lies to the axis, the smaller the centrifugal force acting thereon is. Therefore, starting from the state where the centrifugal force acting on any of the fabric articles is larger than the gravity, when the speed of the drum 54 is reduced, the fabric articles lying closer to the drum axis fall off from the pile of the fabric articles first. Accordingly, by reducing the speed properly, it is possible to keep some fabric articles pressed on the inner peripheral wall of the drum 54 and, at the same time, to make the other fabric articles closer to the drum axis fall off from the wall and be scattered.

After reducing the speed for a short time as described above, the speed of the drum 54 is restored to the low speed N1 (step S10) and the magnitude of the eccentric load is judged again (step S11). If the eccentric load is still larger than predetermined, the balance correcting operation is carried out again through the steps S14–S16 so that the fabric articles are scattered more evenly. Usually, by repeating the balance correcting operation a few to several times, the fabric articles can be scattered almost evenly on the inner peripheral wall of the drum 54 and the eccentric load can be settled to be smaller than the predetermined value. In the present embodiment, the time needed to correct the balance is short even when the balance correcting operation is repeated several times since it is only within a proximity to the low speed N1 that the speed of the drum 54 is changed.

Provided that the diameter of the drum is 910 [mm] and the low speed N1 is set at about 80 [rpm] in the balance correcting operation described above, the fabric articles can be adequately scattered by setting the scattering speed N4 at about 40 [rpm] and the speed reducing time t at about 0.15 [sec]. Since, at the speed N1, it takes 0.75 [sec] for the drum 54 to rotate once, the speed reducing time t corresponds to about ⅕ of the rotation cycle of the drum 54. It is preferable to determine the scattering speed N4 and the speed reducing time t taking account of various parameters and factors such as the low speed N1, the diameter of the drum, the amount of the fabric articles and the response characteristics of the motor 22.

The efficiency of scattering the fabric articles depends significantly on the timing at which the speed reduction starts, i.e., on the position where the eccentric load exists when the speed reduction starts. If the speed of the drum 54 is reduced to a low speed (i.e., a speed at which the centrifugal force is smaller than the gravity) after the eccentric load has passed the highest position of the drum 54, the fabric articles do not fall off and the distribution cannot be changed because of the inertia. Therefore, in order to promote the falling off of the fabric articles, it is preferable to reduce the drum speed while the eccentric load is within an angular range of about 90° before the highest position of the drum 54.

Under the above described condition including the speed of the drum 54 and other factors, the positive peak of the motor current appears when the eccentric load comes at an angular position before the highest position of the drum 54 by about 30°–45°. The timing when the peak appears varies depending on the speed of the drum 54 and other factors. Besides, there is a time lag between the time when the speed reducing position designating unit 162 sends a pulse signal to the speed control unit 14 and the time when the speed of the drum 54 is actually reduced. Further, the time lag changes depending on the constitution of the speed control unit 14 and the invertor control circuit 20. In view of the above situations, the speed reducing position designating unit 162 may be constituted to generate a pulse signal earlier or later than the time position (or angular position) of the peak of the motor current by an appropriate time (or an appropriate angle) in order to start the speed reduction at the timing when the eccentric load comes to the proper angular position as described above.

The second embodiment of the spin extractor according to the present invention is then described. The drum type washing machine of the present embodiment, in which the spin extractor of the second embodiment is installed, has the same structure as shown in FIG. 1 and includes the same electric system as shown in FIG. 2. Here, however, it should be noted that, in the washing machine of the second embodiment, the operating programs stored in the memory 18 of the control unit 10 are different from those of the first embodiment, and the control steps in the extracting operation is different accordingly.

Figure 8A:
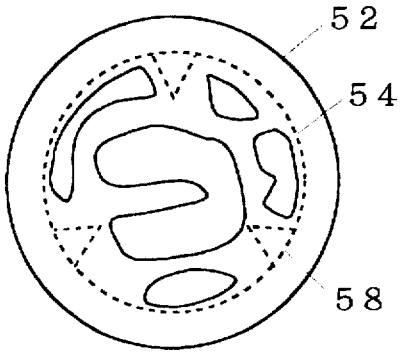
FIGS. 8A, 8B, 8C and 8D illustrate a movement of the fabric articles in the drum of the spin extractor of the second embodiment.

In the spin extractor of the first embodiment, the fabric articles causing the eccentric load are made to fall off from the inner peripheral wall of the drum in the balance correcting operation, whereby they are moved and scattered in the drum. If, however, a fabric article having a large volume, such as a blanket or futon, is included in the drum 54, the fabric articles in the drum 54 may not be scattered effectively because of the following reason. After washed or rinsed, the volume of the blanket or the like is relatively small because it is wet. Then, as the speed of the drum 54 is raised to the low speed N1 for detecting the eccentric load, the water held in the blanket is gradually extracted even though the speed is low. Specifically, water is extracted more promptly at the part of the blanket closer to the drum axis. As water is extracted, the volume of the blanket increases because of its elasticity and the void or free space at the center of the drum becomes smaller. This prevents the other fabric articles in the drum from moving freely during the balance correcting operation, so that the balance cannot be corrected effectively (FIG. 8A).

Figure 7:
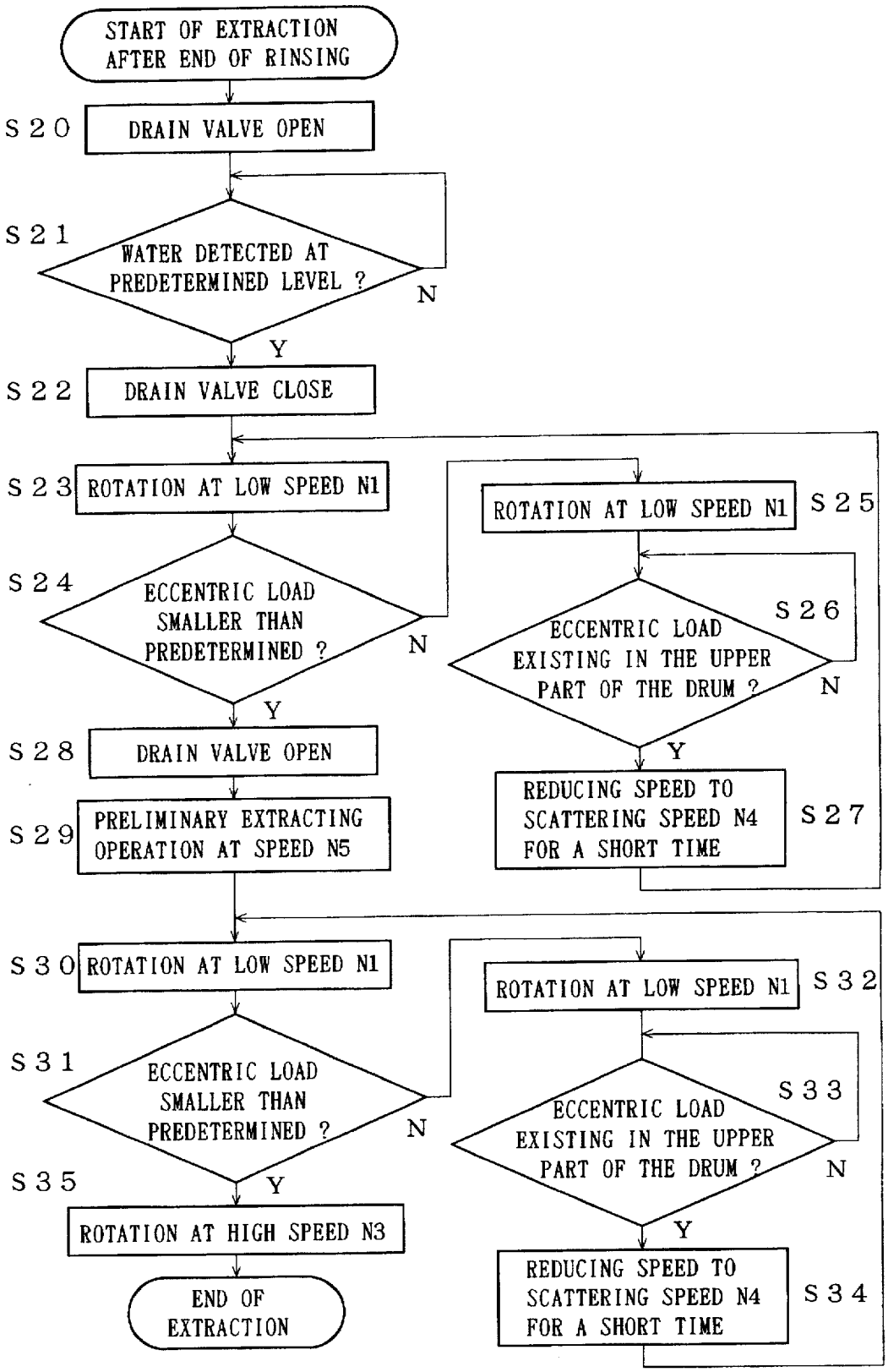
FIG. 7 is a flow chart of an extracting process by a spin extractor of the second embodiment.

The spin extractor of the second embodiment is designed so that the balance of the fabric articles can be corrected properly even in such a case as described above. FIG. 7 is a flow chart showing control steps of the extracting process by the washing machine of the second embodiment.

In a drum type washing machine to which the present invention relates, the washing or rinsing operation is carried out generally with a quantity of water retained in the tub 52 at about a quarter to half of its capacity. In the conventional washing machine, the water used in the washing or rinsing operation is drained completely before the extracting operation is started. In the washing machine of the second embodiment, on the other hand, the extracting operation is started under the condition that a portion of the water used in washing or rinsing is left in the tub 52. For example, after the rinsing operation is finished, the drain valve 80 is opened to start draining the rinsing water (step S20). The water level in the tub 52 is monitored by a water level sensor (not shown in the drawing). When it is detected that the water has decreased to a predetermined level (step S21), the drain valve 80 is closed(step S22). The predetermined level is preferably such that an appropriate quantity of water remains in the lower part of the drum 54. For example, the depth of water in the tub 52 may be about a tenth of the distance between the bottom of the tub 52 and its center. It is not recommended to leave an excessive amount of the water because of a reason explained later.

Under the above starting condition, the fabric articles are crammed and piled in the lower part of the drum 54, where each fabric article holds some amount of water and its volume is relatively small. Then, the speed control unit 14 starts the motor 22 and generates a speed designating signal to rotate the drum 54 at the low speed N1 where the centrifugal force acting on the fabric articles is a little larger than the gravity. The inverter control circuit 20 applies a voltage to the motor 22 according to the speed designating signal (step S23).

Figure 8B:
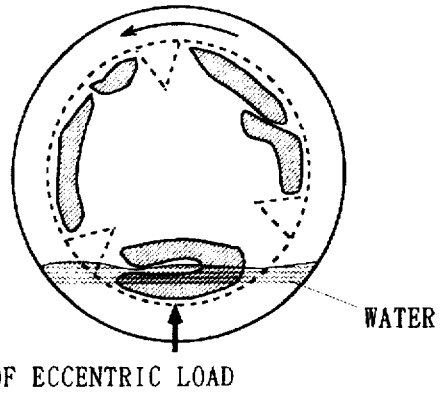

While the drum 54 is rotated at the low speed N1, all the fabric articles are pressed on the inner peripheral wall of the drum 54 due to the centrifugal force (FIG. 8B). Even though the speed of the drum 54 is low, the water is gradually extracted from the fabric articles pressed on the inner peripheral wall of the drum 54. In the present spin extractor, however, the extraction of water from the fabric article cannot go further since the fabric articles are dipped into the water at the lower part of the drum 54 every time they pass there, so that the fabric articles always hold some quantity of water. Thus, in the present spin extractor, such a fabric article that swells in the extracting operation by the conventional spin extractor does not swell and remains small in the volume.

The water retained in the lower part of the tub 52 causes a resistance to the rotation of the drum 54. If the water is left excessively in the lower part of the drum 54, the resistance is so large that the motor current significantly fluctuates, which deteriorates the accuracy of detecting the eccentric load. It is therefore preferable that the above predetermined water level is set as low as possible within such a range that the fabric articles can absorb an appropriate quantity of water during the rotation of the drum 54.

Figure 9A:
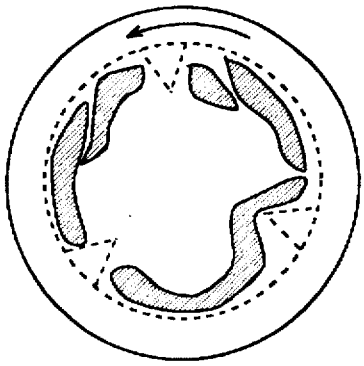
FIGS. 9A and 9B illustrate a movement of the fabric articles in the drum of the spin extractor of the second embodiment.
Figure 9B:
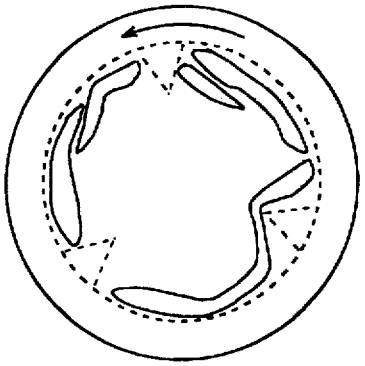

While the drum 54 is rotated as described above, the eccentric load judging unit 16 judges whether the amplitude of fluctuations in the motor current detected by the motor current detecting unit 26 is smaller than the predetermined value (step S24). If the amplitude of the fluctuations in the motor current is judged to be smaller than the predetermined value, the drain valve 80 is opened so that all the water remaining in the tab 52 is drained (step S28, FIG. 9A). Then, the speed control unit 14 generates a speed designating signal to rotate the drum 54 at a preliminary extracting speed N5, and the inverter control circuit 20 applies a voltage corresponding to the speed designating signal to the motor 22 (step S29, FIG. 9B). For example, the preliminary extracting speed N5 may be about 200–300 [rpm]. Though the absorbing ratios of fabric articles vary depending on the material of the fabric or method of weaving or knitting, generally it can be said that the weight of the water held by a fabric article before extraction is about four times that held by the same fabric article after extraction. With the preliminary extracting operation of about one minute, about half of the water held by the fabric article can be extracted in the above case.

After the preliminary extracting operation is finished, the operation proceeds to step S30, where the speed control unit 14 generates again a speed designating signal to rotate the drum 54 at the low speed N1, and the inverter control circuit 20 applies the voltage to the motor 22 corresponding to the speed designating signal. As a result, the speed of the drum 54 is reduced, maintaining such a state that the fabric articles, whose weight is decreased by the preliminary extracting operation, are pressed on the inner peripheral wall of the drum 54.

While the drum 54 is rotated at the low speed N1, the eccentric load judging unit 16 judges again whether the amplitude of fluctuations in the motor current is smaller than the predetermined value (step S31). If the amplitude is judged to be smaller than the predetermined value, the operation proceeds to step S35, where the proper extracting operation is carried out at high speed. That is, the speed control unit 14 generates a speed designating signal to rotate the drum 54 at a high speed N3, and the inverter control circuit 20 applies a voltage to the motor 22 according to the speed designating signal. As a result, the speed of the drum 54 increases rapidly. The high speed extracting operation is continued for a predetermined time period so that the water can be extracted adequately from the fabric articles. After the high speed extracting operation is finished, the drum 54 is stopped, where all the extracting process is completed.

Figure 8C:
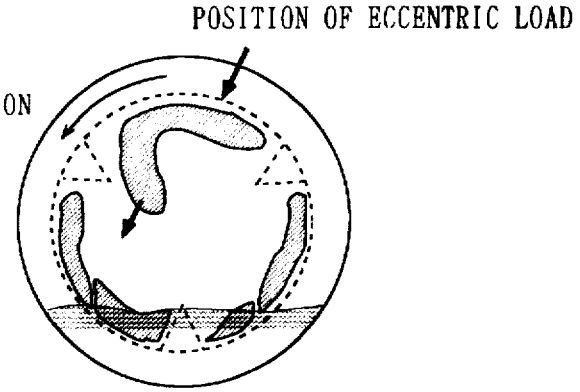
Figure 8D:
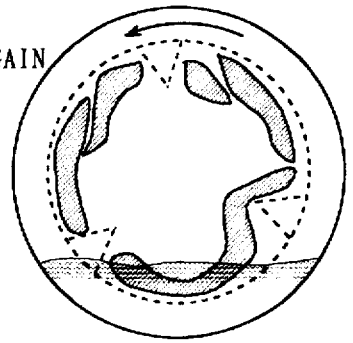

If, in step S24, the eccentric load is judged to be larger than the predetermined value, the balance correcting operation is carried out by a process of steps S25–S27 which are similar to steps S14–S16 described in the first embodiment. Since, in this case, the balance correcting operation is carried out with water retained in the lower part of the drum 54, the fabric articles are kept always wet. Therefore, even a fabric article with a large volume, such as a blanket or futon, is maintained relatively small and a large free space is assured unoccupied in the drum for the other fabric articles to move and scatter therein (FIG. 8C). After the balance correcting operation is finished, the eccentric load is detected and judged again (FIG. 8D). If the eccentric load is judged to be larger than the predetermined value, the balance correcting operation is carried out again.

Even when the eccentric load is judged to be smaller than the predetermined value in step S24, the eccentric load may increase in step S29 as a result of the preliminary extracting operation. In this case, if the high speed extracting operation is carried out without correcting the balance, the abnormal vibration may occur. Provided, for example, that the water-absorbing ratio of one fabric article is much larger than that of another fabric article, and both have equal weight when dried. When both of the fabric articles are fully wet, the fabric article having larger water-absorbing ratio weighs more than the fabric article having smaller water-absorbing ratio. In other words, even if the balance is corrected by the balance correcting operation of steps S25–S27 while both are fully wet, the balance may be lost in the preliminary extracting operation as the water is extracted and their weights change differently. In view of this situation, in the present spin extractor, when the eccentric load is judged to be larger than the predetermined value in step S31, another balance correcting operation is carried out by a process of steps S32–S34, which is similar to the process of steps S14–S16 of the first embodiment. Since, in this case, the weight of each fabric article is closer to the weight after the extracting operation is completed, better balance can be achieved by the above balance correcting operation than by the balance correcting operation of steps S25–S27, unless fabric articles having a large volume, such as a blanket or futon, is included.

The spin extractor of the second embodiment can be preferably used for extracting water from such a fabric article as a thin large sheet. Such fabric article tends to become a small lump during the balance correcting operation when a quantity of water is retained. By the spin extractor of the second embodiment, such fabric article can spread easily by the balance correcting operation after the preliminary extracting operation. Thus, in case that such a fabric article alone is contained in the drum, the balance can be corrected after the preliminary extracting operation though the balance may not be corrected when the water is retained.

In the above case, if the balance correcting operation is repeated unconditionally until the eccentric load is settled to be smaller than the predetermined value in step S24, the balance correcting operation may be repeated endlessly under a certain condition. For preventing this, the eccentric load may be judged also in step S24 as follows. First, the balance correcting operation is repeated a predetermined times. Then the smallest eccentric load is determined among the eccentric loads detected while the balance correcting operation is repeated. After that, the balance correcting operation is repeated again until the eccentric load detected is equal to or near the above-determined smallest eccentric load. Here, of course, the balance correcting operation is finished if the eccentric load detected is judged to be smaller than the predetermined value. By this method, an endless repetition of the balance correcting operation can be prevented and the balance of the fabric articles can be corrected to an allowable extent, thus the operation can proceed to step S28.

The judgement on the eccentric load in step S31 may be also carried out as described above. That is, the eccentric load is compared to a reference value equal to or near the minimum eccentric load detected while the balance correcting operation of steps S32–S34 is repeated a preset number of times. If the eccentric load is judged to be smaller than the reference value, the high speed extracting operation is started. In this case, it is preferable to limit the speed of the drum 54 depending on the magnitude of the eccentric load detected just before the high speed extracting operation is started, since it is not preferable to raise the speed to the maximum speed when the eccentric load is not adequately small.

In the above embodiments, spin extractors for extracting water (or rotary dehydrators) are described. Of course, the spin extractor of the above embodiments can be applied to a dry cleaner using petroleum solvent or the like. Further, it should be noted that the above embodiments are mere examples and can be modified within the true spirit and scope of the present invention.

What is claimed is:

1. A spin extractor for extracting liquid from fabric articles contained in a drum by rotating the drum about a horizontal axis, the spin extractor comprising:

a) a motor for rotating the drum;

b) eccentricity detecting means for detecting a magnitude of an eccentric load due to an uneven distribution of the fabric articles pressed on the inner peripheral wall of the drum by a centrifugal force while the drum is rotated;

c) judging means for judging whether the magnitude of the eccentric load detected by the eccentricity detecting means is smaller than a predetermined value;

d) position detecting means for detecting that a part of the drum at which the eccentric load exists comes to a proximity to a predetermined angular position; and e) operation control means for controlling the motor by a process comprising:

a first step wherein the motor is controlled so that the drum is rotated at a first speed at which the centrifugal force acting on the fabric articles is larger than a gravity acting thereon, and the judging means judge the eccentric load;

a second step wherein, when the magnitude of the eccentric load is judged to be larger than the predetermined value in the first step, the speed of the drum is reduced to a second speed at which the centrifugal force on the fabric articles is smaller than the gravity for a short time according to a timing signal generated by the position detecting means; and a third step wherein, when the magnitude of the eccentric load is judged to be smaller than the predetermined value in the first step, the speed of the drum is raised to a high speed for a proper extracting operation.

2. The spin extractor according to claim 1 wherein the operation control means reduce the speed of the drum in the second step in an upper half of a rotation that is after the part of the drum at which the eccentric load exists passes the level of the drum axis upwards and before the same part of the drum passes the level of the drum axis downwards.

3. The spin extractor according to claim 2 wherein the operation control means reduce the speed of the drum to the second speed for a short time once every time the drum is rotated a plurality of times at a speed at which the centrifugal force on the fabric articles is larger than the gravity.

4. The spin extractor according to claim 1 wherein the eccentric load is judged in the first step and the drum speed is reduced to the second speed in the second step in such a state where a quantity of liquid is retained in a lower part of the drum so that the fabric articles contact the liquid.

5. The spin extractor according to claim 4 and applicable to such a spin extractor that the extracting operation is carried out subsequent to a washing or rinsing operation, wherein the judging means judge the eccentric load in the state where a predetermined portion of liquid used in the washing or rinsing operation is left in the drum after the other portion of the liquid is drained so that the fabric articles contact the liquid.

6. The spin extractor according to claim 5 wherein the operation control means perform a process comprising:

a first step wherein, when the magnitude of the eccentric load is judged to be smaller than a predetermined value by the judging means, a preliminary extracting operation is carried out at a predetermined extracting speed of the drum which is somewhat lower than the high speed for the proper extracting operation;

a second step wherein the speed of the drum is reduced to judge the eccentric load by the judging means again;

a third step wherein, when the magnitude of the eccentric load is judged to be larger than the predetermined value in the second step, the speed of the drum is reduced to the second speed for a short time according to the timing signal generated by the position detecting means; and a fourth step wherein, when the magnitude of the eccentric load is judged to be smaller than the predetermined value in the second step, the speed of the drum is raised to the high speed.

7. The spin extractor according to claim 1 wherein:

the eccentricity detecting means comprises motor current detecting means for detecting an electric current supplied to the motor and calculating means for calculating an amplitude of fluctuations in the electric current; and the judging means judge the eccentric load by comparing an output value from the calculating means to a predetermined value.

8. The spin extractor according to claim 7 wherein the position detecting means generate a timing signal based on a position of a peak in the fluctuations in the motor current detected by the motor current detecting means.

9. The spin extractor according to claim 8 wherein, when the eccentric load is being detected, the operation control means control the motor to rotate the drum at a speed in proximity to a speed at which the centrifugal force on the fabric articles is almost equal to the gravity.

* * * * *